US005335867A

United States Patent [19]

Stehr et al.

[11] Patent Number: 5,335,867

[45] Date of Patent: Aug. 9, 1994

[54] AGITATOR MILL

[75] Inventors: Norbert Stehr, Grünstadt; Philipp Schmitt, Lampertheim, both of Fed. Rep. of Germany

[73] Assignee: Draiswerke GmbH, Mannheim, Fed. Rep. of Germany

[21] Appl. No.: 910,926

[22] Filed: Jul. 9, 1992

[30] Foreign Application Priority Data

Jul. 9, 1991 [DE] Fed. Rep. of Germany ..... 4122680

[51] Int. Cl.[5] ..... B02C 17/16

[52] U.S. Cl. ..... 241/69; 241/171; 241/172

[58] Field of Search ..... 241/69, 171, 172

[56] References Cited

U.S. PATENT DOCUMENTS

| | | | |
|---|---|---|---|
| 3,780,957 | 12/1973 | Wilhelm . | |
| 3,814,334 | 6/1974 | Funk | 241/171 |
| 4,174,074 | 11/1979 | Geiger | 241/172 X |
| 4,739,936 | 4/1988 | Stehr . | |
| 4,998,678 | 3/1991 | Dürr | 241/172 X |

FOREIGN PATENT DOCUMENTS

| | | | |
|---|---|---|---|
| 2154713 | 5/1973 | Fed. Rep. of Germany | 241/172 |
| 2234076 | 10/1978 | Fed. Rep. of Germany . | |
| 2834726 | 2/1979 | Fed. Rep. of Germany | 241/172 |
| 3103662 | 8/1982 | Fed. Rep. of Germany . | |
| 3119078 | 12/1982 | Fed. Rep. of Germany . | |
| 3345799 | 6/1985 | Fed. Rep. of Germany | 241/172 |
| 3521668 | 12/1986 | Fed. Rep. of Germany . | |
| 275188 | 1/1990 | Fed. Rep. of Germany . | |
| 8502559 | 6/1985 | PCT Int'l Appl. | 241/172 |

*Primary Examiner*—Mark Rosenbaum
*Assistant Examiner*—Frances Chin
*Attorney, Agent, or Firm*—Browdy and Neimark

[57] ABSTRACT

An agitator mill for treating free-flowing grinding stock comprises a discharge device, which is provided with a separating device to be disposed in the grinding chamber. In the separating device a mixing device is arranged, which comprises a mixing body movable in longitudinal direction of the cylindrical separating device.

22 Claims, 3 Drawing Sheets

AGITATOR MILL

FIELD OF THE INVENTION

The invention relates to an agitator mill for treating free-flowing grinding stock, with a grinding container delimiting a largely closed, essentially cylindrical grinding chamber and an agitator mechanism disposed in the grinding container and rotatably drivable around a common central longitudinal axis, a grinding stock inlet pipe opening into the grinding chamber, which is partially filled with auxiliary grinding bodies, and a grinding stock discharge device opening out of the grinding chamber, which discharge device comprises a separating device for retaining the auxiliary grinding bodies in the grinding chamber.

BACKGROUND OF THE INVENTION

An agitator mill of this type is known from U.S. Pat. No. 3,780,957, wherein the separating device consists of one or more so-called screen cartridges, i.e. screens with a circular cylindrical cross-section, which protrude into the grinding chamber. From U.S. Pat. No. 4,739,936 it has become known to provide these screen cartridges with a relatively flat cross-section, i.e. with an approximately elliptical cross-section or with a cross-section with walls which are parallel to each other. The basic shape of the screens is as usual cylindrical, but is not anymore circular cylindrical.

From DE 35 21 668 A an agitator mill is known, the agitator shaft of which having at its free end a hollow space, into which a separating device in the shape of a cylindrical screen protrudes. In this separating device a mixing body is arranged, which can be cooled.

From DE 22 34 076 C3 an agitator mill is known, the separating device of which is disposed at the agitator shaft itself and rotates with the latter. Within this separating device, which separates the grinding bodies, at least one scraper is provided, in order to prevent clogging of the separating device during the treatment of thixotrope fluids.

All the above-described separating devices have in common that the passage openings for the grinding stock must be very small, as the separating devices should retain the auxiliary grinding bodies, which are as a rule very small. When the grinding stock passes through these relatively narrow openings, which form as a whole a narrow passage cross-section, into the regularly relatively large cross-section of the separating device, a strong reduction of the flow speed of the grinding stock occurs. This leads to a strong reduction of the shearing in the grinding stock. Therefore so-called pseudoplastic grinding stocks take on a higher local viscosity. Furthermore the grinding stock distinctly adheres to the separating device because of the large inner surfaces of the separating device. In fact with the agitator mill with a coolable mixing body in the separating device the flow speed is only slightly reduced; however, the viscosity is increased more distinctly due the cooling of the grinding stock. The above-described problems entail difficulties when cleaning the agitator mills by means of rinsing fluid for the purpose of preparation for a grinding stock exchange. Rinsing fluids of this type are as a rule low-viscous. Because of the extremely different rheological characteristics of the rinsing fluid on the one side and of the grinding stock, and that in particular of the pseudoplastic grinding stock, on the other hand, an only poor miscibility is given. During rinsing often conduits are formed; the low-viscous rinsing fluid flows through the accumulation of tenacious grinding stock in the hollow separating device without discharging the grinding stock. Furthermore difficulties also appear due to the fact that grinding stock agglomerates, which are still not completely dispersed when passing once through the agitator mill, can clog the separating device. The same occurs when comminuting relatively rough particulate solids. Also fibres or other foreign particles can lead to the clogging of the separating device.

SUMMARY OF THE INVENTION

It is an object of the invention to embody the agitator mill of the generic type such that a cleaning of the agitator mill is possible in a simple and reliable manner in particular in the region of the discharge device.

This object is attained according to the invention in that a mixing device is arranged in the separating device, in that the mixing device comprises a mixing body, which is movable in relation to the separating device, and which is provided with a scraper, the scraper resting on the inner surface of the separating device, in that the separating device is formed cylindrically and the mixing body including the scraper is essentially adapted to the inner cross-section of the separating device, and in that the mixing body is displaceably arranged in the separating device in direction to a central longitudinal axis of the separating device. By means of the measures according to the invention it is attained that the grinding stock available in the separating device can be mixed with the rinsing fluid during the cleaning process, enabling a faster discharge of the grinding stock of this type which is remained in the separating device. Furthermore, it is attained that on the one hand when moving the mixing body the grinding stock which adheres to the inner surface of the separating device is scraped off, and that on the other hand the grinding stock is put into motion by the mixing body and thus can be mixed with the rinsing fluid in a simpler manner. By the invention it is attained that the whole inner surface of the separating device is actuated by the mixing body including its scraper when moving the mixing body in relation to the separating device, whereby the grinding stock is scraped off the inner surface of the separating device. The separating device need not be circular cylindrical; it must only be cylindrical, i.e. it must be defined by jacket lines which are parallel to each other. Especially with the further improvement according to which the mixing body is displaceable approximately over the full length of the separating device, a complete cleaning is possible. The displaceability of the mixing body is furthermore advantageous in that on the one hand the size of the surface, which is responsible for the outlet, of the separating device can be adjusted, when for example the mixing body is held in an intermediate position between its end positions. By means of this the free flow cross-section for the flowing-off grinding stock can be reduced, by means of which higher flow speeds are enforced, so that the initially described problems do not occur or only to a small extend. On the other hand material, which is deposited in the dead space between the free end of the separating device and the mixing body, can be pressed back by the mixing body from the separating device into the grinding chamber, where it mixes faster with rinsing fluid. This is possible in a particularly simple manner in the further embodiment according to which the mixing body has a bottom surface which corresponds in its shape essentially to an end surface of the separating device. The mixing body acts in this case like a press-out piston.

By means of the further embodiment according to which a grinding stock discharge conduit is provided, which opens out from the separating device, according to which the mixing body comprises a jacket surface tapering towards the discharge conduit, and according to which a transition surface approximately adapted to the jacket surface is provided between the separating device and the grinding stock discharge conduit, it is attained that also in the transition to the grinding stock discharge conduit high flow speeds are attained with correspondingly good mixing effects between grinding stock and rinsing fluid. In particular with the further improvements according to which the jacket surface is essentially conically formed, and the transition surface is formed as an essentially conical transition funnel, and the angles of inclination of the jacket surface and of the transition funnel are slightly different, a reduction of the viscosity of the grinding stock can be attained by additional shearing effects and increased mixing activities can be attained by nozzle effects. If the angle of inclination of the jacket surfaces of the mixing body is slightly larger than the angle of inclination of the transition funnel, when the grinding stock is squeezed out through the separating device when moving the mixing body against the transition funnel. If, however, the angle of inclination of the transition funnel is slightly larger than the angle of inclination of the jacket surface of the mixing body, then with this movement the grinding stock is pressed into the grinding stock discharge conduit.

For producing the linear displacement movement of the mixing body the lifting rod is disposed at the mixing body, with which engages a linear drive, which can be a pneumatically or hydraulically driven piston-cylinder drive, a crank drive, an electromagnet drive or any other suitable drive. Instead of a drive of this type also a manual operation can be provided, according to which a handle is in engagement with the mixing body. By means of the further embodiment according to which scraper elements are connected with the mixing body, which abut at least partially on the inner wall of the grinding stock discharge conduit, it is attained that with the displacement movements of the mixing body also the discharge conduit is cleaned and grinding stock deposited here is brought together with the rinsing fluid in an intensive manner.

By means of the further embodiment according to which a swing drive is arranged in the mixing body, it is furthermore attained that also in the space between the jacket surface of the mixing body and the transition funnel the grinding stock is subject to shearing, so that decreases in viscosity with the described disadvantages do not occur. By means of this an intensification of the mixing of grinding stock and rinsing fluid is achieved during rinsing. By means of the further embodiment according to which the mixing body can be fixed in the separating device, it is attained that the free opening area of the separating device can be adjusted by a corresponding fixing of the mixing body in a certain position in relation to the separating device.

Further features, details and advantages of the invention will become apparent from the ensuing description of an agitator mill, to the grinding stock discharge device of which different examples of embodiments are described in conjunction with the drawing.

DESCRIPTION OF THE PREFERRED EMBODIMENTS

Figure 1:
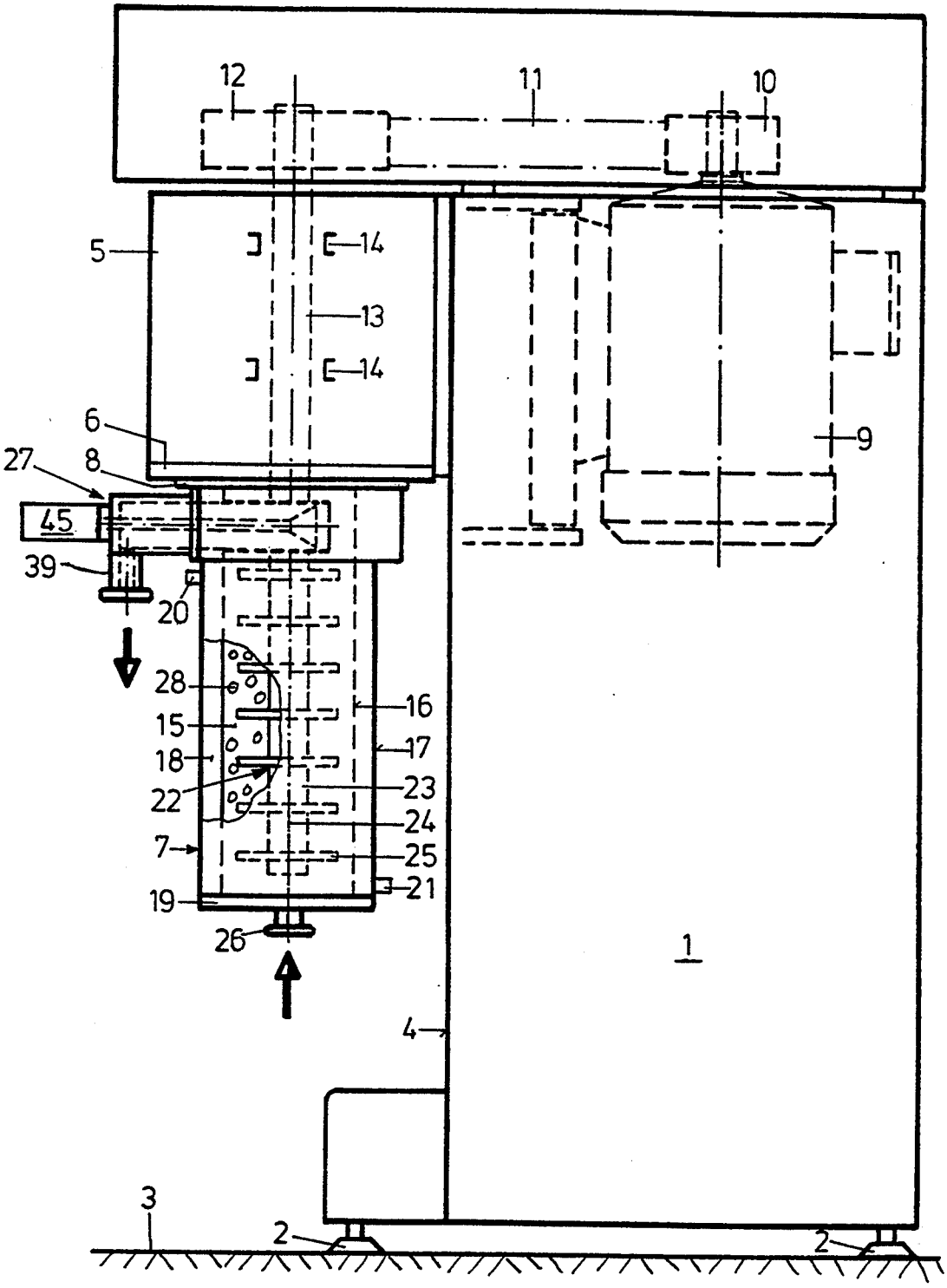
FIG. 1 shows a diagrammatical illustration of an agitator mill in a longitudinal view with a grinding container in a partially cut-away representation.

The agitator mill shown in FIG. 1 comprises in usual manner a stand 1, which is supported via feet 2 in relation to the bottom 3. At the front side 4 of the stand 1 a supporting housing 5 protruding downwards is disposed. At its underside the supporting housing 5 is provided with a cover 6 for a grinding container 7, which is essentially cylindrical, which has at its upper edge a flange 8, which can be secured to the cover 6 by means of screws not shown.

In the stand 1 a drive motor 9 is arranged, the speed of which can be controlled, which is provided with a V-belt pulley 10, by which via V-belts 11 and via a further V-belt pulley 12 a drive shaft 13 can be rotatably driven. The drive shaft 13 is rotatably supported in the supporting housing 5 by means of several bearings 14.

The grinding container 7 comprises an inner cylinder 16 surrounding a grinding chamber 15, which inner cylinder 16 is surrounded by an outer jacket 17, which is also essentially cylindrical. The inner cylinder 16 and the outer jacket 17 delimit between them a cooling chamber 18. The lower bottom of the grinding chamber 15 is formed by a bottom plate 19. Cooling water is supplied to the cooling chamber 18 of the grinding container 7 via a coolant inlet pipe 20, and is discharged via a coolant outlet pipe 21.

At the drive shaft 13 passing through the cover 6 an agitator mechanism 22 is disposed. It consists essentially of a cylindrical agitator shaft 23 and of agitator tools 25, which are disposed at the agitator shaft 23 and which project thereof radially to its central longitudinal axis. A grinding stock inlet pipe 26, which is open towards the grinding chamber 15, is disposed concentrically to the axis 24 at the bottom plate 19. Adjacent to the cover 6 a grinding stock discharge device 27 is provided. Through this grinding stock discharge device 27 grinding stock, which is ground or dispersed in the grinding chamber 15 by means of auxiliary grinding bodies which are available there, is discharged of the grinding chamber 15 after separation of the auxiliary grinding bodies 28.

Figure 2:
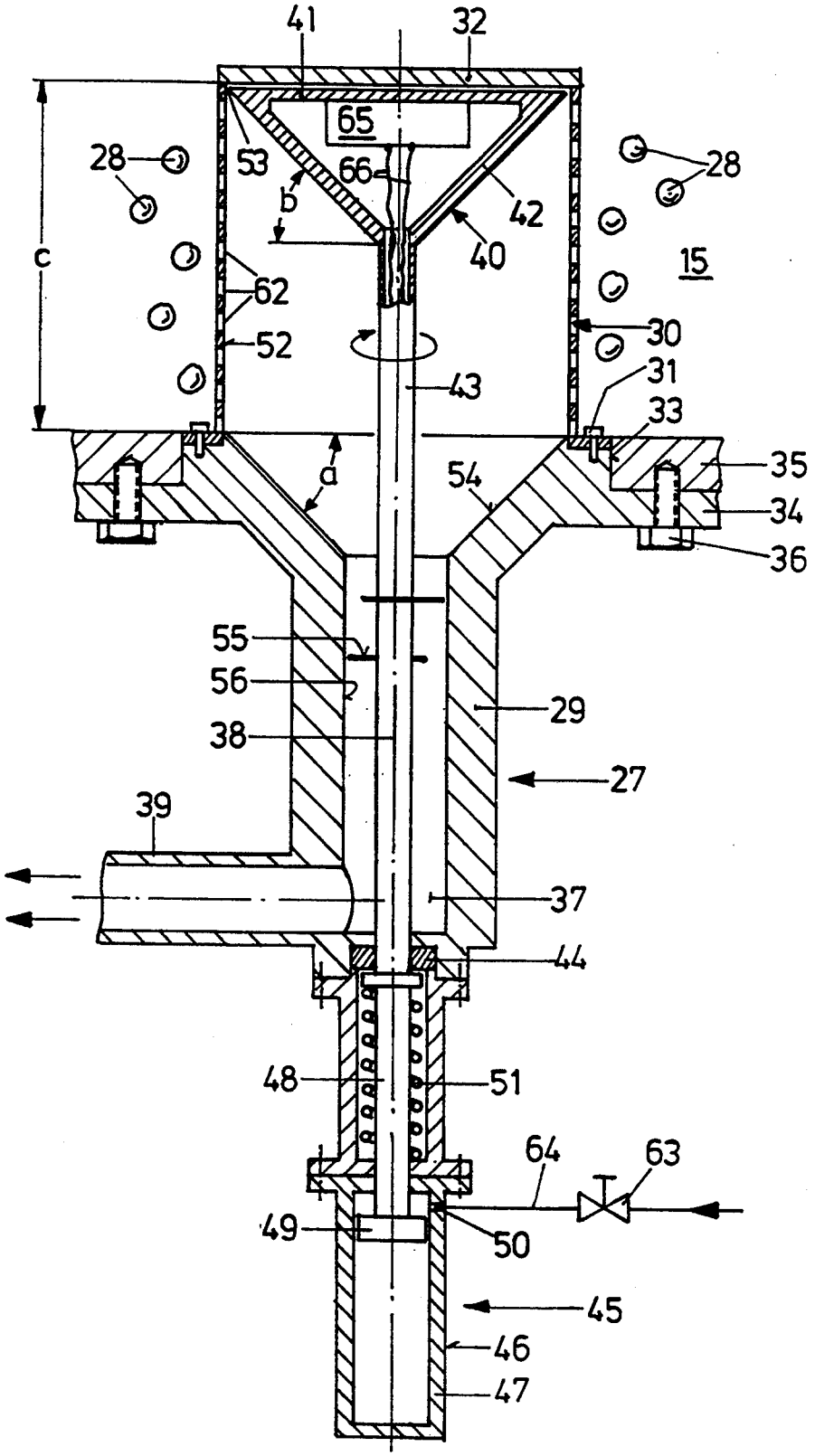
FIG. 2 shows the discharge device of the agitator mill in a longitudinal section.

An example of embodiment of a grinding stock discharge device 27 is shown in FIG. 2. It comprises a fastening housing 29, at which a screen 30, which is as a rule cylindrical, is fastened by means of screws 31, which serves as a separating device. The cylindrical screen 30 is closed with a cover plate 32 at its side facing away from the housing 29. The screen 30 is pushed through a corresponding opening 33 in the grinding container 7 into the grinding chamber 15. In this case a flange 34 formed at the housing 29 rests on a counter flange 35 formed at the grinding container 7, with which counter flange 35 it is screwed by means of screws 36. By means of this the entire grinding stock discharge device 27 is connected with the grinding container 7 on the one hand and on the other hand can be easily removed from the latter.

In the fastening housing 29 a grinding stock discharge conduit 37 is formed, which extends concentrically to the central longitudinal axis 38 of the discharge device 27. From this discharge conduit 37 a discharge pipe 39 opens transversely to the axis 38, through which the discharged grinding stock flows off.

In the cylindrical screen 30 a conical mixing body 40 is arranged, the bottom surface 41 of which extends parallel to the cover plate 32 of the screen 30, i.e. radially to the axis 38. The axis of the conical mixing body 40 coincides with the axis 38. The conical jacket surface 42 of the mixing body 40 tapers in direction towards the fastening housing 29.

At the mixing body 40, namely in the vicinity of the tip of the jacket surface 42, a lifting rod 43 is disposed, which runs coaxially with the axis 38 and which is passed through the discharge conduit 37 and which is passed out of the latter behind the discharge pipe 39 through a seal 44. In this section a linear drive 45 is flange connected, which contains in this example of embodiment of a hydraulically or pneumatically driven piston cylinder drive 46. It comprises a cylinder 47, in which a piston 49 provided with a piston rod 48 is displaceably supported in direction of the axis 38. The piston rod 48 extended from the cylinder 47 is connected with the lifting rod 43. As the cylinder 47 can only be driven in one direction, i.e. as only one pneumatic or hydraulic supply 50 opens into it, the piston rod 48 is provided with a restoring spring 51, which when relieving the cylinder 47 pushes the piston rod 48 and thus the lifting rod 43 and thus the mixing body 40 into a position, in which the bottom surface 41 of the mixing body 40 abuts on the cover plate 32, as is shown in FIG. 2.

The mixing body 40 comprises a scraper edge 53, which rests on the inner surface 52 of the screen 30 at the transition from its jacket surface 42 to its bottom surface 41, and which serves as a scraper. At the transition from the screen 30 to the discharge conduit 37 a transition funnel 54 is formed in the housing 29, into which transition funnel 54 the mixing body 40 with its jacket surface 42 immerges when moving away from the cover plate 32 of the screen, so that the scraper edge 53 of the mixing body 40 can scrape the entire inner surface 52 of the screen 30 in direction of the axis 38. The angle of inclination a of the funnel 54 and the corresponding angle of inclination b of the jacket surface 42 are in the range of 30° to 60°. Due to reasons of practice the angles of inclination a and b are approximately 45°. They can be different by several degrees, so that the jacket surface 42 does not rest in flat manner in the funnel 54. The difference between them can be in the range of 2° to 10°. If the angle of inclination b of the jacket surface 42 is larger than the angle of inclination a of the transition funnel 54, then, when moving the mixing body 40 against the transition funnel 54, the grinding stock is pressed back into the grinding chamber 15. If, however, the angle of inclination b of the jacket surface 42 is smaller than the angle of inclination a of the transition funnel 54, then, when moving the mixing body correspondingly, the grinding stock is pressed into the grinding stock discharge conduit 37.

At the lifting rod 43 scraper elements 55 are disposed in the section located in the discharge conduit 37, which scraper elements 55 rest respectively on one part of the inner wall of the discharge conduit 37. All scraper elements 55 together cover at least once the entire circumference of the inner wall 56, so that with a movement of the lifting rod 43 extending over a complete lifting of the mixing body 40 over the full axial length c of the screen 30, the entire inner wall 56 of the discharge conduit 37 is actuated by the scraper elements 55 at least approximately, by means of which deposits of grinding stock in the discharge conduit 37 are avoided or removed. The scraper elements 55 for example can also have the shape of a spiral or can be formed helically.

Figure 3:
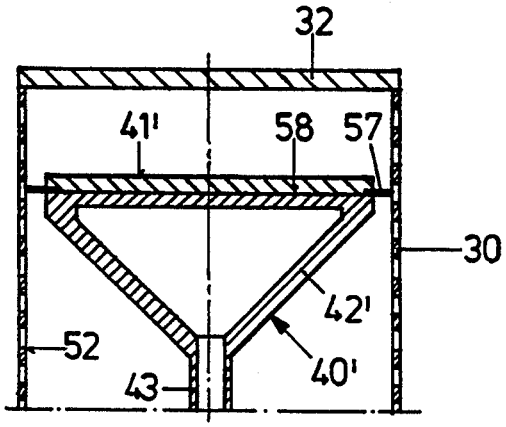
FIG. 3 shows a part section of a discharge device with a modified mixing body and FIG. 4 shows a part-illustration of a modified drive for a mixing body.

In FIG. 3 a part section of a modified example of embodiment is illustrated. It differs from the discharge device 27 according to FIG. 2 only in that the mixing body 40′ does not comprise a relatively sharp-edged scraper edge at the transition from its jacket surface 42′ to its bottom surface. The jacket surface 42′ rather ends in low radial distance from the inner surface 52 of the screen 30. On this place a scraper ring 57 is disposed as a scraper, which is held by means of a holding plate 58 at the mixing body 40′. The exposed surface of the holding plate 58 forms the bottom surface 41′ of the mixing body 40′. The scraper ring 57 is made of a relatively stiff material, so that it can accomplish the scraper function.

Figure 4:
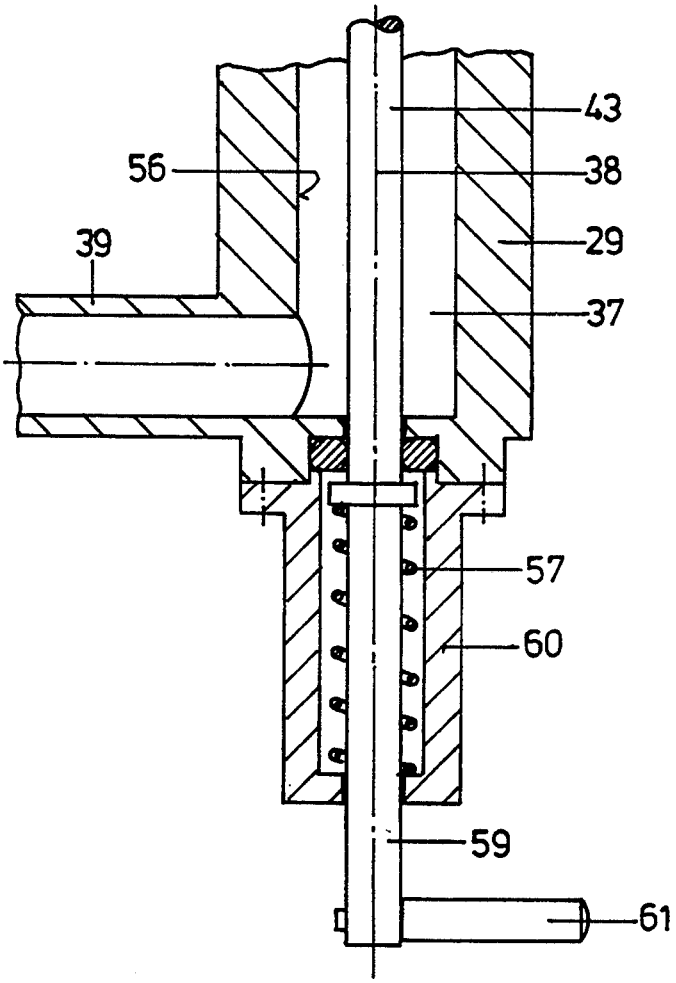

In FIG. 4 a simplified example of embodiment for the linear lifting drive of the lifting rod 43 is shown. In this case the piston cylinder drive 46 is omitted. Instead of the piston rod an operating rod 59 is disposed coaxially with the axis 38 at the lifting rod 43. The operating rod 59 is guided through a spring housing 60, which is disposed at the fastening housing 29, and which in principle is provided between the housing 29 and the piston cylinder drive 46 in same manner as in the example of embodiment according to FIG. 2. In this spring housing 60 a restoring spring 51 is disposed. At the free end, protruding from the spring housing 60, of the operating rod 59 a handle 61 is disposed, by means of which the described lifting movement of the mixing body 40 or 40′ can be carried out. At the same time also the mixing body 40 or 40′ can be rotated around its axis 38.

The function is as follows: When it is necessary to convert to another grinding stock, then the agitator mill must be cleaned, i.e. all surfaces contacting the grinding stock must be cleaned. To this effect rinsing fluid is supplied through the grinding stock inlet pipe 26 during continuous operation of the agitator mill and directly following the grinding stock, so that the grinding stock available in the agitator mill is pressed out. Following this the actual cleaning process starts. During the passage of the rinsing fluid through the grinding chamber 15 and through the discharge device 27 the mixing body 40 or 40′ is moved forth and back by means of the linear drive 45 or manually by means of the handle 61. When moving the mixing body 40, 40′ against the cover plate 32 grinding stock located between the cover plate 32 and the bottom surface 41, 41′ of the mixing body 40, 40′ is pressed back through the openings 62 of the screen 30 into the grinding chamber 15 and is mixed there with the rinsing fluid. Grinding stock is scraped off from the inner surface 52 of the screen 30 by means of the scraper edge 53 or by means of the scraper ring 57, so that the grinding stock can be carried along by the rinsing fluid. When moving the mixing body 40 or 40′ in direction to the transition funnel 54, the free flow cross-section within the screen 30 keeps getting smaller, so that the flow speed increases while correspondingly increasing the cleaning effect.

During the return stroke, in which the mixing body 40 or 40′ is moved towards the cover plate 32 of the screen 30, the rinsing fluid accumulated in this space is pressed through the openings 62 of the screen 30 back into the grinding chamber and cleans on this occasion also the openings 62 of the screen 30.

If scraper elements 55 are disposed at the lifting rod 43, during the lifting movement also the inner wall 56 of the grinding stock discharge conduit 37 is cleaned by a corresponding sraping and is cleared of adhering grinding stock.

During a normal grinding or dispersing process the free opening area and thus the free flow cross-section within the discharge device 27 can be adjusted with the mixing body. The closer the mixing body 40 or 40′ is fixed towards the transition funnel 54, the smaller is this free flow cross-section and thus the higher is the flow speed of the grinding stock. The higher the flow speed, the lower the risk of deposits. With the example of embodiment according to FIG. 2 a positioning of this type of the mixing body 40 or 40′ can be carried out by means of a valve 63 in the pressure medium supply duct leading to the supply 50. If the piston 49 is located in a certain position, the valve 63 is closed, so that the piston 49 and with that also the mixing body 40 or 40′ remain in a given position.

By the way, also during the normal grinding or dispersing process the screen 30 can be cleaned from inside by means of the mixing body 40 or 40′ by occasional lifting movements.

In the mixing body 40 or 40′ a swing drive 65, i.e. an electric or pneumatic swing drive 65, can be arranged, the supply ducts 66 of which are fed through the hollow-formed lifting rod 43. A swing drive 65 of this type sets the mixing body 40 or 40′ into vibrations, which run in direction of the central longitudinal axis 38, which vibrations lead to the fact that the grinding stock, which flows off between the jacket surface 42 and the transition funnel 54 into the discharge conduit 37, is subject to shearing, which assures that the viscosity remains on a low level. By means of this the risk of deposits is further reduced. During rinsing this leads to corresponding mixing activities between grinding stock and rinsing fluid.

What is claimed is:

1. An agitator mill for treating free-flowing grinding stock, with a grinding container (7) delimiting a largely closed, essentially cylindrical grinding chamber (15) and an agitator mechanism (22) disposed in the grinding container (7) and rotatably drivable around a common central longitudinal axis (24), a grinding stock inlet pipe (26) opening into the grinding chamber (15), which is partially filled with auxiliary grinding bodies (28), and a grinding stock discharge device (27) opening out of the grinding chamber (15), which discharge device (27) comprises a separating device (30) for retaining the auxiliary grinding bodies (28) in the grinding chamber (15), wherein a mixing device is arranged in the separating device (30), wherein the mixing device comprises a mixing body (40, 40′) which is movable in relation to the separating device (30), and which is provided with a scraper (53, 57), the scraper resting on the inner surface (52) of the separating device (30), wherein the separating device (30) is formed cylindrically and a cross-sectional area of the mixing body (40, 40′) including the scraper (53, 57) perpendicular to a central longitudinal axis (38) of the mixing body is essentially identical to the inner cross sectional area of the separating device (30), and said cross-sectional area of the mixing body (40, 40′) is closed, and wherein the mixing body (40, 40′) is displaceably arranged in the separating device (30) to move in a direction parallel to that of said central longitudinal axis (38) of the separating device (30).

2. An agitator mill according to claim 1, wherein the mixing body (40, 40′) is displaceable approximately over the full length (c) of the separating device (30).

3. An agitator mill according to one of claims 1, wherein the mixing body (40, 40′) has a bottom surface (41, 41′), which corresponds in its shape essentially to an end surface (32) of the separating device (30).

4. An agitator mill according to one of claims 3, wherein a grinding stock discharge conduit (37) is provided, which opens out from the separating device (30), wherein the mixing body (40, 40′) comprises a jacket surface (42, 42′) tapering towards the discharge conduit, and wherein a transition surface approximately adapted to the jacket surface (42, 42′) is provided between the separating device (30) and the grinding stock discharge conduit (37).

5. An agitator mill according to claim 4, wherein the jacket surface (42, 42′) is essentially conically formed.

6. An agitator mill according to claim 4, wherein the jacket surface (42, 42′) is essentially conically formed, and wherein the transition surface is formed as an essentially conical transition funnel (54).

7. An agitator mill according to claim 6, wherein the angles of inclination (b, a) of the jacket surface (42, 42′) and of the transition funnel (54) are slightly different.

8. An agitator mill according to claim 4, wherein scraper elements (55) are connected with mixing body (40, 40′), which abut at least partially on the inner wall (56) of the grinding stock discharge conduit (37).

9. An agitator mill according to claim 1, wherein a lifting rod (43) is disposed at the mixing body (40, 40′).

10. An agitator mill according to claim 9, wherein a handle (61) is in engagement with the mixing body (40, 40′).

11. An agitator mill according to claim 1, wherein a linear drive (45) is in engagement with the mixing body (40, 40′).

12. An agitator mill according to claim 1, wherein a handle (61) is in engagement with the mixing body (40, 40′).

13. An agitator mill according to claim 1, wherein a swing drive (65) is arranged in the mixing body (40).

14. An agitator mill according to claim 1, wherein the mixing body (40) can be fixed in the separating device (30).

15. An agitator mill for treating free-flowing grinding stock, with a grinding container (7) delimiting a largely closed, essentially cylindrical grinding chamber (15) and an agitator mechanism (22) disposed in the grinding container (7) and rotatably drivable around a common central longitudinal axis (24), a grinding stock inlet pipe (26) opening into the grinding chamber (15), which is partially filled with auxiliary grinding bodies (28), and a grinding stock discharge device (27) opening out of the grinder chamber (15), which discharge device (27) comprises a separating device (30) for retaining the auxiliary grinding bodies (38) in the grinding chamber (5), wherein a mixing device is arranged in the separating device (30), wherein the mixing device comprises a mixing body (40, 40′) which is movable in relation to the separating device (30), and which is provided with a scraper (53, 57), the scraper resting on the inner surface (52) of the separating device (30), wherein the separating device (30) is formed cylindrically and a cross-sectional area of the mixing body (40, 40') including the scraper (53, 57) perpendicular to a central longitudinal axis (38) of the mixing body is essentially identical to the inner cross-sectional area of the separating device (30, and said cross-sectional area of the mixing body being is closed, wherein the mixing body (40 , 40') is displaceably arranged in the separating device (30) to move in a direction parallel to that of said central longitudinal axis (38) of the separating device (30), wherein a lifting rod (43) is disposed at the mixing body (40, 40'), and wherein a linear drive (45) is in engagement with the mixing body (40, 40').

16. An agitator mill according to claim 15, wherein the mixing body (40, 40') is displaceable approximately over the full length (c) of the separating device (30).

17. An agitator mill according claim 15, wherein the mixing body (40, 40') has a bottom surface (41, 41'), which corresponds in its shape essentially to an end surface (32) of the separating device (30).

18. An agitator mill according to claim 17, wherein a grinding stock discharge conduit (37) is provided, which opens out from the separating device (30), wherein the mixing body (40, 40') comprises a jacket surface (42, 42') tapering towards the discharge conduit, and wherein a transition surface approximately adapted to the jacket surface (42, 42') is provided between the separating device (30) and the grinding stock discharge conduit (37).

19. An agitator mill according to claim 18, wherein the jacket surface (42, 42') is essentially conically formed.

20. An agitator mill according to claim 18, wherein the jacket surface (42, 42') is essentially conically formed, and wherein the transition surface is formed as an essentially conical transition funnel (54).

21. An agitator mill according to claim 20, wherein the angles of inclination (b, a) of the jacket surface (42, 42') and of the transition funnel (54) are slightly different.

22. An agitator mill according to claim 15, wherein the mixing body (40) can be fixed in the separating device (30).

* * * * *